US006154138A

United States Patent [19]

Nilsson

[11] Patent Number: 6,154,138

[45] Date of Patent: Nov. 28, 2000

[54] ALARM DEVICE FOR CLOTHES AND METHOD AND USE OF A LABEL

[75] Inventor: Claes-Göran Nilsson, Borås, Sweden

[73] Assignee: Nilörn AB, Boras, Sweden

[21] Appl. No.: 09/381,138

[22] PCT Filed: Mar. 10, 1998

[86] PCT No.: PCT/SE98/00431

§ 371 Date: Sep. 8, 1999

§ 102(e) Date: Sep. 8, 1999

[87] PCT Pub. No.: WO98/40856

PCT Pub. Date: Sep. 17, 1998

[30] Foreign Application Priority Data

Mar. 10, 1997 [SE] Sweden ..... 9700860

[51] Int. Cl.[7] ..... G08B 13/14

[52] U.S. Cl. ..... 340/572.8; 340/571; 340/572.1; 340/572.7; 156/48; 156/308.2

[58] Field of Search ..... 340/573.1, 573.4, 340/545, 568, 571, 572.1, 572.8, 572.7, 527.9; 156/148, 308.2; 428/29

[56] References Cited

U.S. PATENT DOCUMENTS

| | | | |
|---|---|---|---|
| 4,626,311 | 12/1986 | Taylor | 156/308.2 |
| 5,003,291 | 3/1991 | Strom-Olson | 340/551 |
| 5,017,907 | 5/1991 | Cordery et al. | 340/551 |
| 5,049,855 | 9/1991 | Slemon et al. | 340/550 |
| 5,508,684 | 4/1996 | Becker | 340/572 |
| 5,583,489 | 12/1996 | Loemker et al. | 340/572 |
| 5,624,514 | 4/1997 | Frowein | 156/148 |
| 5,677,674 | 10/1997 | Wolf | 340/541 |
| 5,896,087 | 4/1999 | Frowein | 340/572 |
| 6,068,895 | 5/2000 | Kimura | 428/29 |

FOREIGN PATENT DOCUMENTS

| | | | |
|---|---|---|---|
| 9429503 | 12/1994 | European Pat. Off. | 11/2 |

*Primary Examiner*—Jeffery A. Hofsass
*Assistant Examiner*—Phung Nguyen
*Attorney, Agent, or Firm*—Orum & Roth

[57] ABSTRACT

The Invention relates to a device (1) for clothes (2) and others which device after activation is arranged to function as protection against theft of the object in question by cooperation with an alarm indicator gate, a hand scanner or any similar control apparatus. A label (3) which is woven comprises an electric alarm (4) inserted into a woven label (3).

6 Claims, 3 Drawing Sheets

ALARM DEVICE FOR CLOTHES AND METHOD AND USE OF A LABEL

Figure 1:
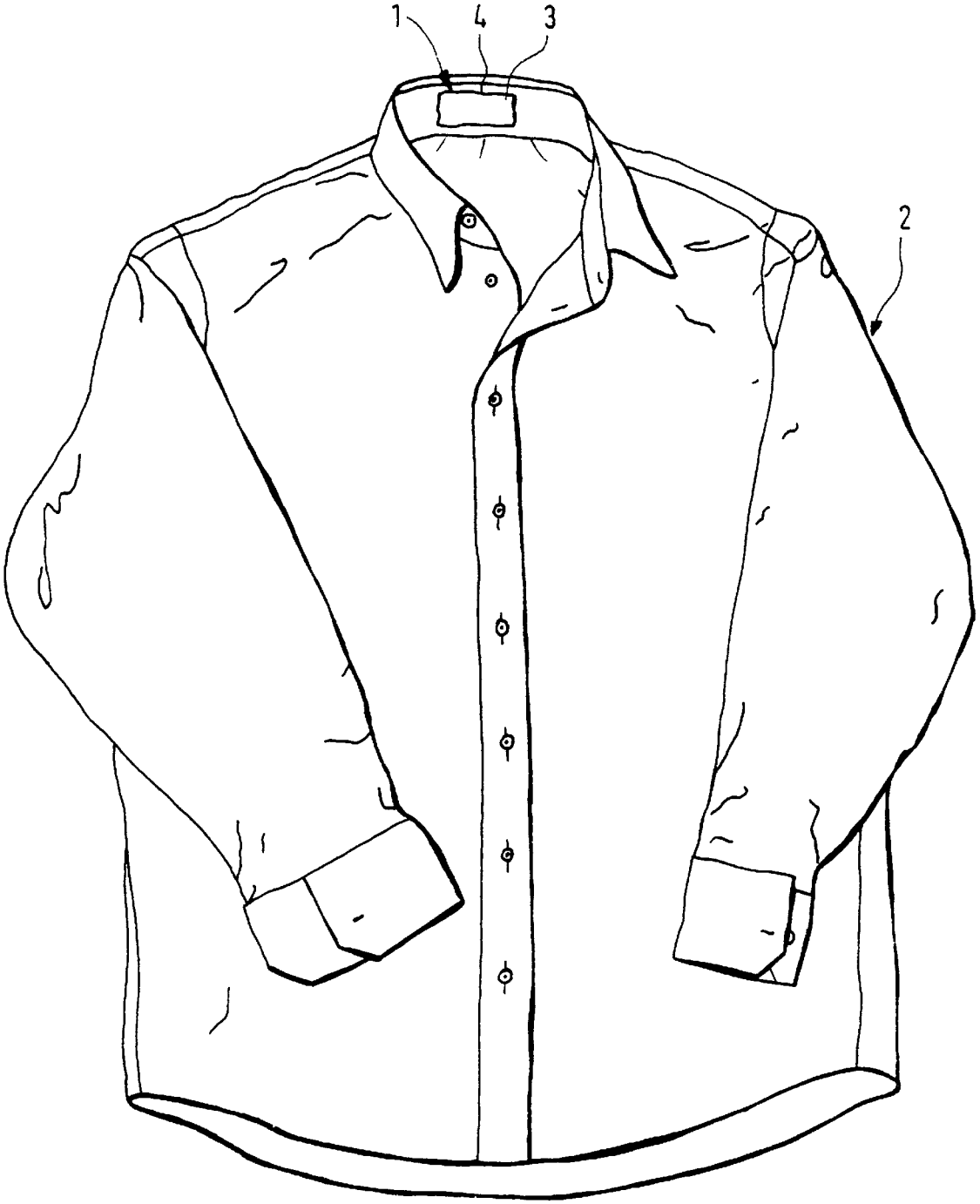

The present invention relates to a device for clothes and other objects which device after activation is arranged to function as protection against theft of the object in question by cooperation with an alarm indicator gate, a hand scanner or any similar control apparatus.

Special alarm tabs have been mounted in order to reduce theft of clothes and other objects for sale in shops, onto said objects in the shop and which have been functioning according to RF, radio frequency or EM, the electromechanical principle. The alarm is activated inside the shop or inactivated respectively by being moved past a plate or some other set-up for this purpose. Special aids are then needed in order to remove the alarms from the objects without damaging the objects. Said known alarms are easy to recognise and difficult to conceal if so wished.

WO,A1, 94/29503 relates to a label with inserted alarm label while U.S. Pat. No. 5,003,291 and U.S. Pat. No. 5,017,907 shows electromagnetic fibre which may be used for alarm purposes.

However, it is not previously known to have woven alarm labels where the alarm thread is allowed to function as the weft threads or warp threads of the label in question.

If loose separate alarm threads were woven in or in some other way attached in a label according to prior art, it would be simple for those who wished to remove aforementioned alarm thread and thereby destroy the alarm function of the label.

Thus by instead letting the alarm be woven in as the weft or warp thread of the woven label, it is simple to achieve to produce alarming labels and where the alarm may not easily be recognised in order to e.g. afterwards be removed by dishonest persons.

However, it is possible to use thread for example according to prior art, for providing desired alarm function but by applying this alarm thread in a special manner as a normal component of the label.

The main object of the present invention is therefore in the first hand to solve the problem of being able to easily conceal the alarm in the considered objects by simple and well functioning means and not having to alarm mark afterwards and also not having to remove the alarm in the shop.

These objects are achieved by means of a device in accordance with the present invention, which is mainly characterized in that a label which is woven comprises an electronic alarm inserted into the woven label, wherein the alarm is formed by means of weft threads that are woven into the warp threads of the label to form an alarm circuit, or that the alarm is formed by means of a number of the warp threads which are arranged to form an alarm circuit.

Another object of the invention is to find a method which makes it possible to manufacture said alarm labels efficiently and simply. This object is achieved by means of a method which is substantially characterized in that a number of threads are woven into the other threads of the formed label so that they form an alarm circuit.

Finally, one object of the invention is to find a well functioning use of the alarm label.

Said final object is achieved by means of an use according to the invention, which is substantially characterized in that the label is sewn or by some other manner attached to the garment or any other intended object before activation of it, wherein the regular marking label of the garment is used as an alarm label.

Figure 2:
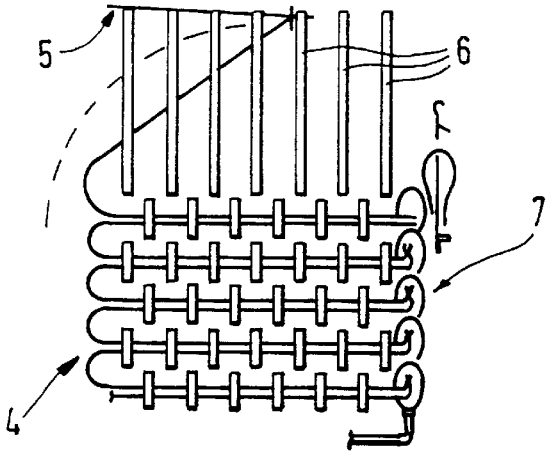
Figure 3:
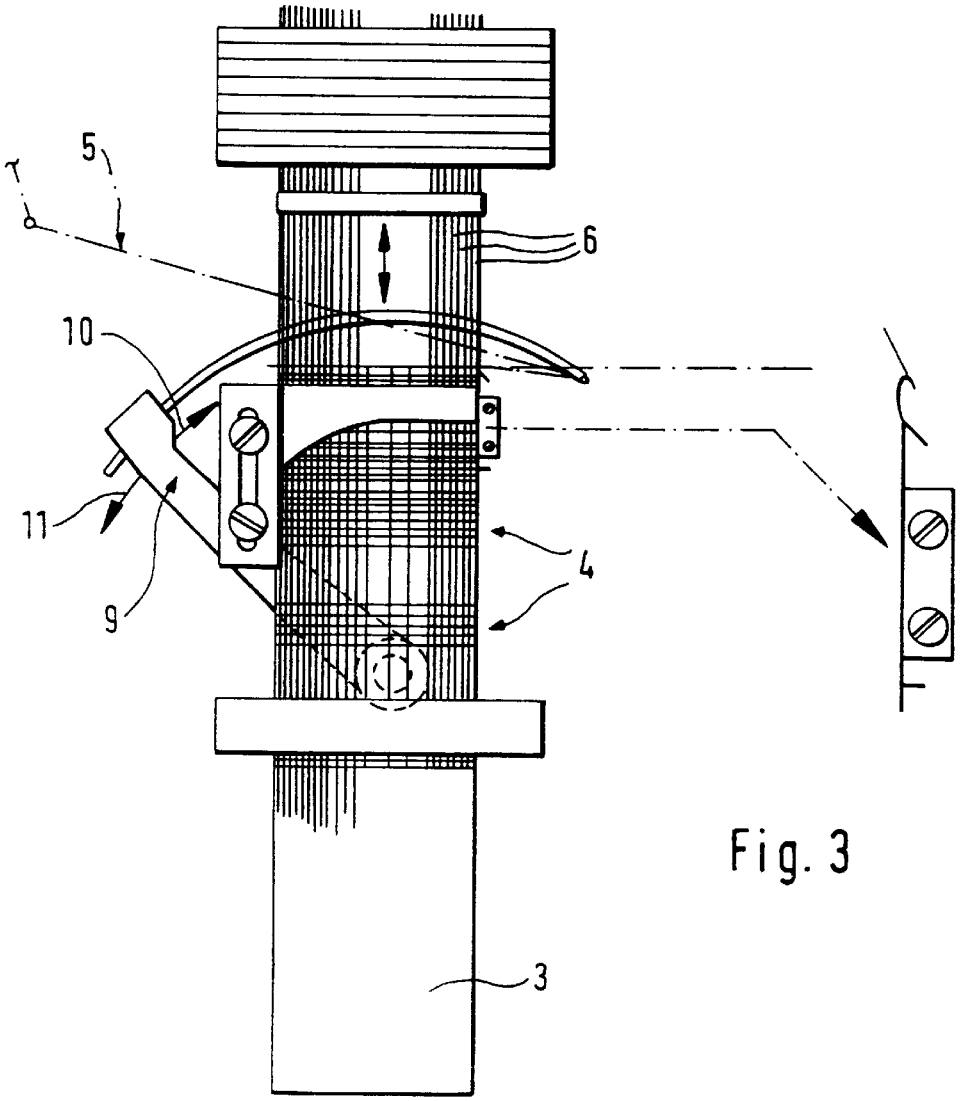
Figure 3A:
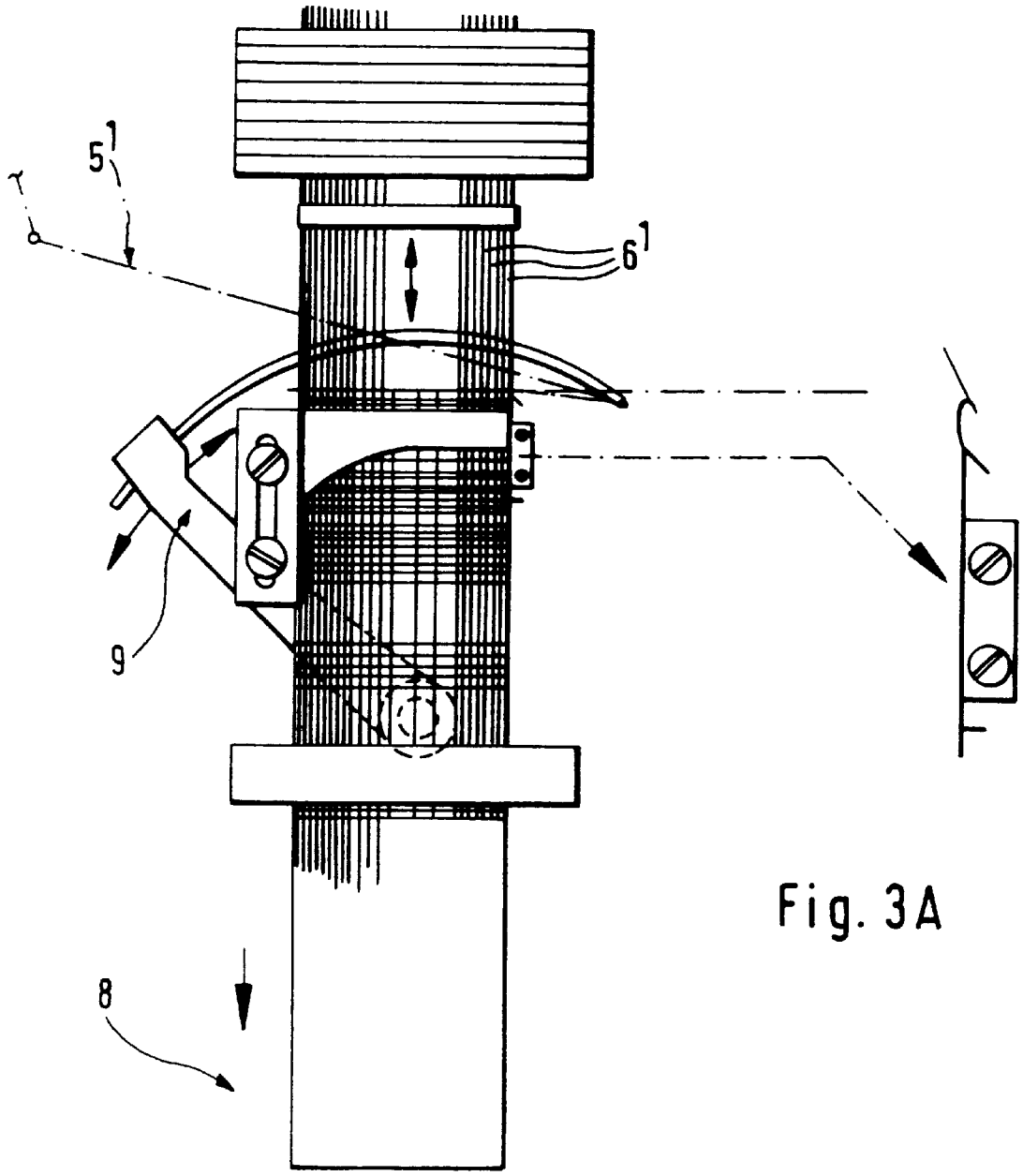

The invention is described here below as a number of preferred embodiments, wherein is referred to the accompanying drawings, in which FIG. 1 shows a garment that has been provided with a woven mark label including alarm, FIG. 2 shows a procedure step during production of labels, FIG. 3 shows a weaving apparatus for production of labels, and FIG. 3A shows alternatives thereof.

The present invention makes it possible to allow inserting of electronically working alarms already at the factory in which is produced garments and other objects which are desired to be provided with alarm. Thus, a device 1 intended for clothes 2 and other objects, which after activation are arranged to function as theft protection for the object 2 in question by cooperation with an according to the art functioning alarm gate, comprising a hand scanner or some similar control apparatus, of a woven label 3, in which an electronically working alarm 4 is inserted.

The alarm 4 may be formed by a number of weft threads 5 which are woven into the warp threads 6 of the woven label 3 for forming an alarm circuit 7.

The alarm $\mathbf{4}^1$, may as is also shown in FIG. 3A be formed by a number of warp threads $\mathbf{6}^1$, which are arranged to form an alarm circuit.

A method for producing a woven label 3 which is intended to be attached to clothes 2 or to other objects like e.g. bags, shoes, boots, tablecloths, rugs etc., and are arranged to after activation of included alarm 4 function as theft protection for the object 2 in question by cooperation with an alarm gate, a hand scanner or some similar electronic control apparatus comprising weaving in a number of threads $\mathbf{5}^1$, $\mathbf{6}^1$, in the other threads $\mathbf{6}^1$, $\mathbf{5}^1$ of the formed label so that they form an alarm circuit 7.

A number of weft threads 5 may be woven in into the warp threads 6 of the formed label 3 so that an alarm circuit 7 is formed by said woven in weft threads 5. For this, an as an alarm 4 forming weft thread 5 may be woven in tightly packed at mutual distances from each other for the respective label 3 along a running label web 8 before being divided up into separate labels 3.

A number of weft threads 5 are woven into the warp threads 6, of which a number are arranged to form an alarm circuit 7 in the respective woven label 3. For this purpose it is possible to weave in an alarm thread 5 into the warp threads 6 by guiding the alarm weft thread 5 to 10 and fro 11 by means of a swinging arm 9.

The use of such a woven label 3 with built in alarm 4 occurs in such a way, that the label 3 in question is sewn or by some other manner attached to the garment 2 or any other intended object before activation of it.

Thus, the original marking label 3 of the garment is used as alarm cable at the inside or outside of the garment etc. 2.

Thus, the invention makes it possible to insert an electronic alarm 4 in woven label 3 by weaving in the alarm 4 in the weaving process which is then activated, and which e.g. is deactivated by moving the garment etc. 2, on which the label 3 is sewn into or onto, over a deactivation plate located in the shop by the sales staff.

Thus, by weaving the alarm 4 into the label 3 it is achieved that it is concealed where on the garment etc. 2 the alarm is located. A large simplification in handling the alarm is that afterwards the garments 2 does not have to be activated, but this takes place in the production and in connection with that the label 3 is sewn into the garment 2, wherein a large simplification in handling in the store occurs when the alarm does not have to be removed at the cashier's desk.

The invention is not limited to the above described and in the drawings shown embodiments but may be varied within the frame of the claims without departing from the inventive concept.

What is claimed is:

1. Device (1) for clothes (2) and other objects which device after activation is arranged to function as protection against theft of the object in question by cooperation with an alarm indicator gate, a hand scanner or control apparatus, characterized in that a label (3) which is woven comprises an electronic alarm (4) inserted into the woven label (3), wherein the alarm (4) is formed by means of weft threads (5) that are woven into the warp threads (6) of the label (3) to form an alarm circuit (7), or that the alarm ($4^1$) is formed by means of a number of the warp threads ($6^1$) which are arranged to form an alarm circuit.

2. Method for producing a woven label (3) which device after activation is arranged to function as protection against theft of the object in question by cooperation with a alarm indicator gate, a hand scanner or control apparatus according to claim 1, characterized in that a number of threads (5, $6^1$) are woven into the other threads (6, $5^1$) of the formed label so that they form an alarm circuit (7).

3. Method according to claim 2, characterized in that a number of weft threads (5) are woven into the warp threads (6) of the formed label (3) so that an alarm circuit (7) is formed by said woven in weft threads (5).

4. Method according to claim 3, characterized in that a weft thread (5) which forms an alarm (4) is woven in packed tightly at mutual distances from each other for the respective label (3) along a label web (8) before being divided up into separate labels (3).

5. Method according to claim 2, characterized in that a number of weft threads (5) are woven into the warp threads (6) of which a number are arranged to form an alarm circuit (7) in the respective woven label (3).

6. Method according to claim 1 wherein, an alarm weft thread is woven into the warp threads by guiding the alarm weft thread (5) by means of a swinging arm (9) to and fro across a label web (8).

* * * * *